US006862007B2

(12) United States Patent
Shoji et al.

(10) Patent No.: US 6,862,007 B2
(45) Date of Patent: Mar. 1, 2005

(54) DRIVING METHOD OF AC-TYPE PLASMA DISPLAY PANEL

(75) Inventors: Takatoshi Shoji, Tokyo (JP); Yukinori Kashio, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 315 days.

(21) Appl. No.: 10/279,713

(22) Filed: Oct. 25, 2002

(65) Prior Publication Data

US 2003/0080928 A1 May 1, 2003

(30) Foreign Application Priority Data

Oct. 26, 2001 (JP) ..... 2001-328496

(51) Int. Cl.[7] ..... G09G 3/10

(52) U.S. Cl. ..... 345/60; 345/63; 315/169.1; 315/169.3

(58) Field of Search ..... 345/60, 63, 67; 315/169.1, 169.3

(56) References Cited

U.S. PATENT DOCUMENTS 6,294,875 B1 * 9/2001 Kurata et al. ..... 315/169.1

6,411,268 B1 * 6/2002 Nakamura et al. ..... 345/60

* cited by examiner

*Primary Examiner*—Amare Mengistu
(74) *Attorney, Agent, or Firm*—Sughrue Mion, PLLC

(57) ABSTRACT

A method for driving an alternating current (AC) plasma display panel is provided which is capable of making sustaining light emission inconspicuous caused by erroneous discharge during a period when supply power becomes stable even if erroneous discharge occurs due to an influence of residual charges produced at a time of starting operations of the AC plasma display panel. A driving method for one frame is changed between a period (supply power stability waiting period) required until the supply power becomes stable and a display period. Time required until a voltage becomes stable is for example 0.5 seconds to 1 second after power-ON. In a field during this period, one field is divided into a plurality of sub-fields and the number of repeated pulses is smaller during a sustaining period of each sub-field than that of repeated pulses during a sustaining period of a sub-field in the display period. For example, no sustaining pulse is fed to a scanning electrode. As a result, sustaining light emission becomes inconspicuous even if the erroneous discharge occurs due to an influence of the residual charges.

14 Claims, 7 Drawing Sheets

DRIVING METHOD OF AC-TYPE PLASMA DISPLAY PANEL

BACKGROUND OF THE INVENTION

1. Field of the Invention

The present invention relates to a method for driving a memory-type AC (Alternating Current) plasma display panel and particularly to the AC plasma display panel being capable of preventing deterioration of an image quality caused by erroneous discharge.

The present application claims priority of Japanese Patent Application No. 2001-328496 filed on Oct. 26, 2001, which is hereby incorporated by reference.

2. Description of the Related Art

FIG. 4 is a cross-sectional view showing a configuration of a conventional AC plasma display panel. In the AC plasma display panel, a front substrate 11 and a rear substrate 15 are provided both of which face each other. Both the front substrate 11 and the rear substrate 15 are constructed of an insulating substrate made of glass.

On the face of the front substrate 11 facing the rear substrate 15 is formed a plurality of pairs of surface discharging electrodes (not shown), each pair of which is made up of a scanning electrode 12*a* and a sustaining electrodes 12*b* being respectively made of an ITO (Indium Tin Oxide) film or a NESA glass film being used as a transparent electrode. Moreover, on each of the scanning electrodes 12*a* and the sustaining electrodes 12*b* is a bus electrode 13 made of a metal electrode used to lower a resistance value between the scanning electrodes 12*a* and the sustaining electrodes 12*b* and a driver (not shown).

As the bus electrode 13, in ordinary cases, there is used a thin multilayer electrode made up of a Cr (chromium) film, a Cu (copper) film, and a Cr film formed and stacked sequentially in this order or a thick film electrode made of Ag (silver). The scanning electrodes 12*a*, sustaining electrodes 12*b*, and bus electrodes 13 are coated with a dielectric layer 14. As a material for the dielectric layer 14, glass with a low melting point is used in ordinary cases. Moreover, on the dielectric layer 14 is formed a MgO (magnesium oxide) film (not shown) with a film thickness of 0.5 $\mu$m to 1 $\mu$m by using a method of vacuum deposition with the aim of preventing damage caused by an ion or an electron generated by discharging and of lowering discharging voltage.

On the other hand, on a face of the rear substrate 15 facing the front substrate 11 is formed a plurality of data electrodes 16 constructed of a thick film made of Ag which extends in a direction orthogonal to a direction in which the scanning electrodes 12*a* and sustaining the electrodes 12*b* extend. Moreover, a white dielectric layer 17 obtained by printing and then burning a glass paste being a mixture of a powder of a white oxide (such as aluminum oxide, titanium oxide, or a like) with a power of glass with a low melting point or a like is formed in a manner so as to cover the data electrode 16. The white dielectric layer 17 has a function of reflecting visible light fed from various kinds of fluorescent layers 18 each providing a different color and guiding the reflected light toward a side of the front substrate 11, thus enhancing an effect by the visible light. Moreover, on the white dielectric layer 17 is formed in a separate manner, by using thick film printing technology, various kinds of the fluorescent layers 18 which convert ultraviolet color produced by gas discharging to visible light.

Furthermore, the front substrate 11 faces the rear substrate 15 being apart from each other by an interval of 100 $\mu$m to 200 $\mu$m with partition walls (not shown) constructed of a grid-shaped or stripe-shaped insulating body being interposed between them and with a discharging cell 19 being sandwiched between them. Discharging gas composed of helium, neon, or xenon, or a mixed gas of these gases or a like is filled in a hermetic manner between the front substrate 11 and the rear substrate 15. Moreover, the partition walls (not shown) are formed by thick film forming technology using a mixture of aluminum oxide, magnesium oxide, titanium oxide, or a like with glass.

Next, discharging operations in the selected discharging cell 19, out of operations of the AC plasma display panel configured as above, are explained by referring to FIG. 5. FIG. 5 is a timing chart showing a conventional method for driving the AC plasma display panel.

One field required for displaying one screen is made up of a plurality of sub-fields and a sustaining erasing period, a pre-discharging period, a pre-discharging erasing period, a writing period, and a sustaining period are set for each sub-field.

First, during the sustaining erasing period, wall charges which occurred in a vicinity of the scanning electrodes 12*a* and the sustaining electrodes 12*b* during the sustaining period of the sub-field existed immediately before are erased by applying an erasing pulse Pe to the scanning electrodes 12*a*.

Then, surface discharge is made to occur between the scanning electrodes 12*a* and the sustaining electrodes 12*b* by applying a pre-discharging pulse $P_p$ to the scanning electrodes 12*a* and the sustaining electrodes 12*b* during the pre-discharging period.

Next, by applying an erasing pulse Pe to the scanning electrodes 12*a* during the pre-discharging erasing period, wall charges which occurred in a vicinity of the scanning electrodes 12*a* and the sustaining electrodes 12*b* during the pre-discharging period are erased.

During the writing period subsequent to the pre-discharging erasing period, by applying a writing pulse $P_w$ so as to scan sequentially an entire screen of the scanning electrodes 12*a* and also by applying a data pulse $P_d$ to the data electrodes 16 in accordance with desired display data in synchronization with the above application of the writing pulse $P_w$, discharging is made to occur selectively between the scanning electrodes 12*a* and the data electrodes 16.

During the sustaining period subsequent to the writing period, by applying a voltage pulse $P_{sus}$ to the scanning electrodes 12*a* and the sustaining electrodes 12*b* in which polarities of the voltage pulse $P_{sus}$ fed to the scanning electrodes 12*a* and sustaining electrodes 12*b* are opposite to each other, opposed discharge occurred during the writing period is maintained as surface discharge between the scanning electrodes 12*a* and sustaining electrodes 12*b* for displaying.

By employing the method described above, during the pre-discharging period and pre-discharging erasing period, since, after the occurrence of the surface discharge on an entire screen, feeble discharging occurs, wall charges existing on electrodes making up the discharging cell 19 are erased and space charges made up of charged particles can be left within the discharging cell 19. Therefore, during the writing period subsequent to these period described above, opposed discharge being made to occur between the scanning electrodes 12*a* and the data electrodes 16 in a manner to correspond to display data can be made to surely occur.

Also, during the writing period, discharging is made to occur between the scanning electrodes 12*a* and the data electrodes 16 and, as a result, positive wall charges are produced on the scanning electrodes 12*a* and negative wall charges are produced on the data electrodes 16. A voltage produced by these wall charges is superimposed on a voltage of the voltage pulse $P_{sus}$ applied to the scanning electrodes 12*a* and sustaining electrodes 12*b* during a subsequent sustaining period and, as a result, the superimposed voltage exceeds surface discharge initiating voltage in a pair of surface discharging electrodes and therefore discharging corresponding to display data is caused to occur and can be maintained. This enables a desired display pattern to be obtained.

Next, a method for achieving a gray-scale display by controlling discharging of the discharging cell 19 in accordance with the driving method described above is explained by referring to FIG. 6 and FIG. 7. FIG. 6 is a timing chart showing a relation between elapsed time and display since a start of operations of the AC plasma display panel according to the conventional method described above and FIG. 7 is a timing chart explaining configurations in one field.

Gray-scale display can be achieved by exerting control on a number of times of discharging during the sustaining period using the driving method explained above. For example, as shown in FIG. 6, one field (F) 4 required for displaying one screen is provided repeatedly 50 to 70 times per one second. As a result, by image retention produced by a human visual sense, a screen for each of the fields (F) 4 is stacked in layers thus enabling a natural image being free from a flicker to be obtained. Moreover, as shown in FIG. 7, by dividing one field period into a plurality of sub-fields (SF) and by changing a number of times of discharging during a sustaining period in each sub-field and by combining these sub-fields, gray-scale display can be achieved.

In FIG. 7, one field is made up of seven sub-fields and at a head of each sub-field a combined period 5 including a sustaining erasing period, a pre-discharging period, and a pre-discharging erasing period is provided and then a writing period 6 and a sustaining period 7 are set in order. By reducing frequency (the number of times) of discharging occurring during the sustaining period 7 by about fifty percent sequentially beginning at a leading sub-field, weights are assigned. According to this method, by selecting the above-described sub-field within one field to have sustaining discharging occur, emitting luminance can be controlled based on the number of times of the sustaining discharging in the selected sub-field, thus enabling gray-scale display to be achieved.

However, when the AC plasma display panel is driven by the conventional method described above, during a period from a start of operations (by power-ON) to a time (within one second) when supply power becomes stable, a level of a voltage pulse does not reach a predetermined value and timing is not yet calibrated. Therefore, the conventional method presents a problem in that erroneous discharge occurs by an influence of residual charges during the writing period or the sustaining period and then light is emitted during the sustaining period in the sub-field and continued emitting of light caused by the erroneous discharge is unfavorably conspicuous.

SUMMARY OF INVENTION

In view of the above, it is an object of the present invention to provide a method for driving an AC plasma display panel being capable of making inconspicuous sustaining light emission caused by erroneous discharge during a period while supply power becomes stable even if erroneous discharge occurs due to an influence by residual charges produced at a time of starting operations of the AC plasma display panel.

According to a first aspect of the present invention, there is provided a method for driving an AC plasma display panel to have the AC plasma display panel perform gray-scale display by dividing one field for displaying one screen into n-pieces ("n" is a natural number) of sub-fields and by setting a number of times of light emission in the sub-fields at values of two kinds or more, said method including:

a step of setting a first period during which predetermined time elapses after a start of operations of the AC plasma display panel and a second period during which display corresponding to an image signal is performed on the AC plasma display panel after a lapse of the first period; and a step of making a total number of sustaining light emissions contained in each field during the first period be smaller than a total number of sustaining light emissions contained in each field during the second period.

With the above configuration, even if erroneous discharge occurs due to an influence by residual charges at a time of operating the AC plasma display panel, the sustaining light emissions caused by the erroneous discharge are made inconspicuous. Therefore, by setting a length of the first period at about a time when the erroneous discharge easily occurs by an influence of the residual charges, a very excellent image quality can be obtained during the second period during which display is actually performed.

In the foregoing, a preferable mode is one wherein the number of the sub-fields contained in each field set during the first period is made smaller than the number of the sub-fields contained in each field set during the second period.

With the above configuration, sustaining light emissions caused by the erroneous discharge are made more inconspicuous.

Also, a preferable mode is one wherein lengths of the sub-fields contained in each field set during the first period are equal to each other.

Also, a preferable mode is one wherein a length of the sub-field contained in each field set during the first period is equal to a length of the sub-field positioned in same order which is contained in each field set during the second period.

In this description, the order denotes an order in which the sub-field is positioned relative to a head sub-field in a field.

Also, a preferable mode is one wherein, in each field set during the first period, a potential of a data electrode is made less than a value produced by opposed discharge occurring between the data electrode and a scanning electrode during a writing period during which the scanning electrode is scanned.

Furthermore, a preferable mode is one wherein a length of the first period is 0.5 seconds to 1 second.

With the above configurations, even if erroneous discharge occurs due to an influence by residual charges produced at a time of start of operations of an AC plasma display panel, during a first period, sustaining light emissions caused by the erroneous discharge can be made inconspicuous. Therefore, by setting a length of the first period to be about a length in which the erroneous discharge easily occurs due to an influence by residual charges during a second period when display is actually performed, a very excellent image quality can be obtained. Moreover, by making smaller the number of sub-fields contained in each field during the first period than that of sub-fields contained in each field during the second period, sustaining light emissions caused by the erroneous discharge is made more inconspicuous.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
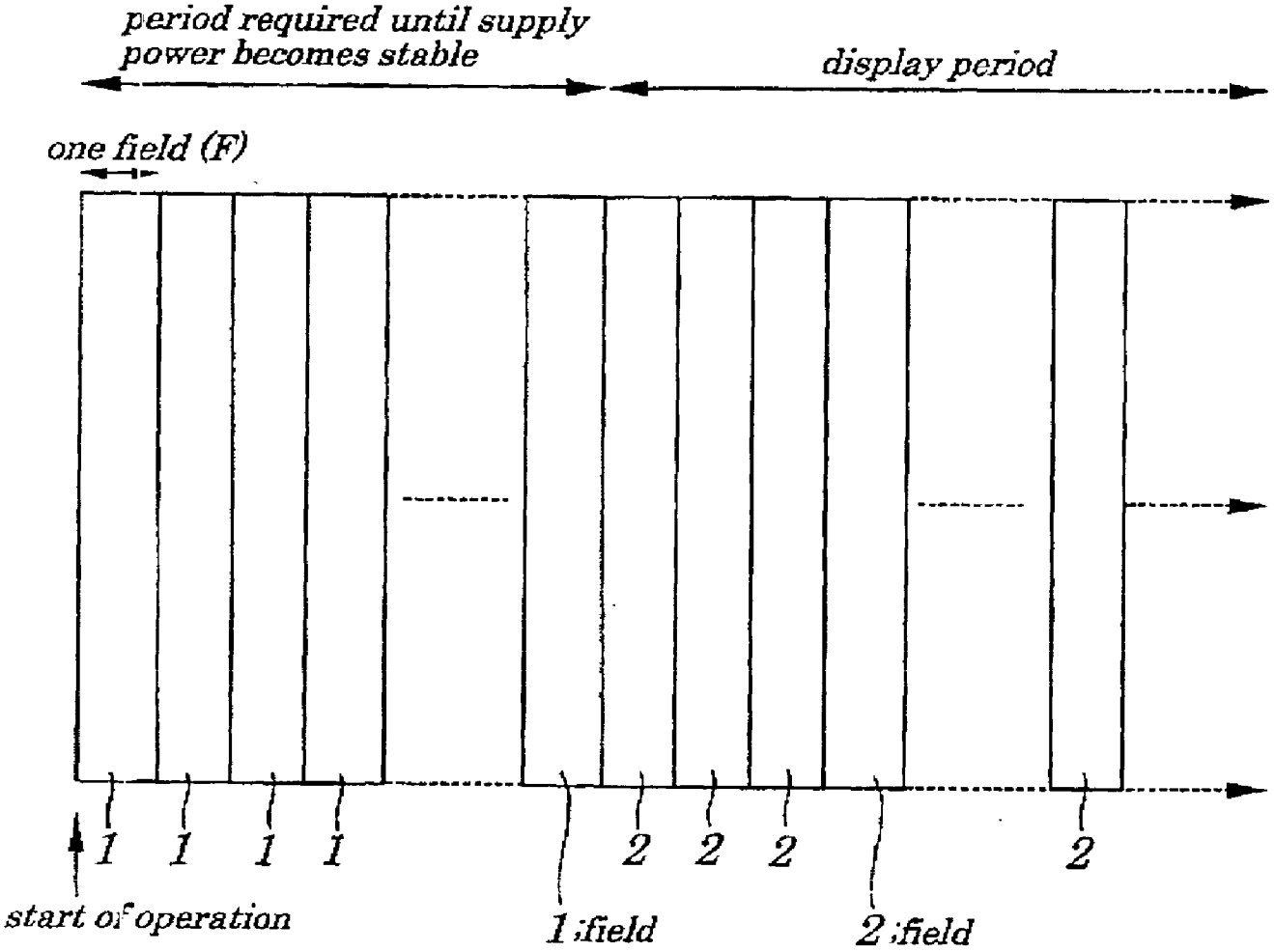
FIG. 1 is a timing chart showing a relation between time elapsed since a start of operations and display according to a method of driving an AC plasma display panel of a first embodiment of the present invention.

FIG. 1 is a timing chart showing a relation between elapsed time and display since a start of operations of driving an AC plasma display panel according to the first embodiment of the present invention.

Figure 2:
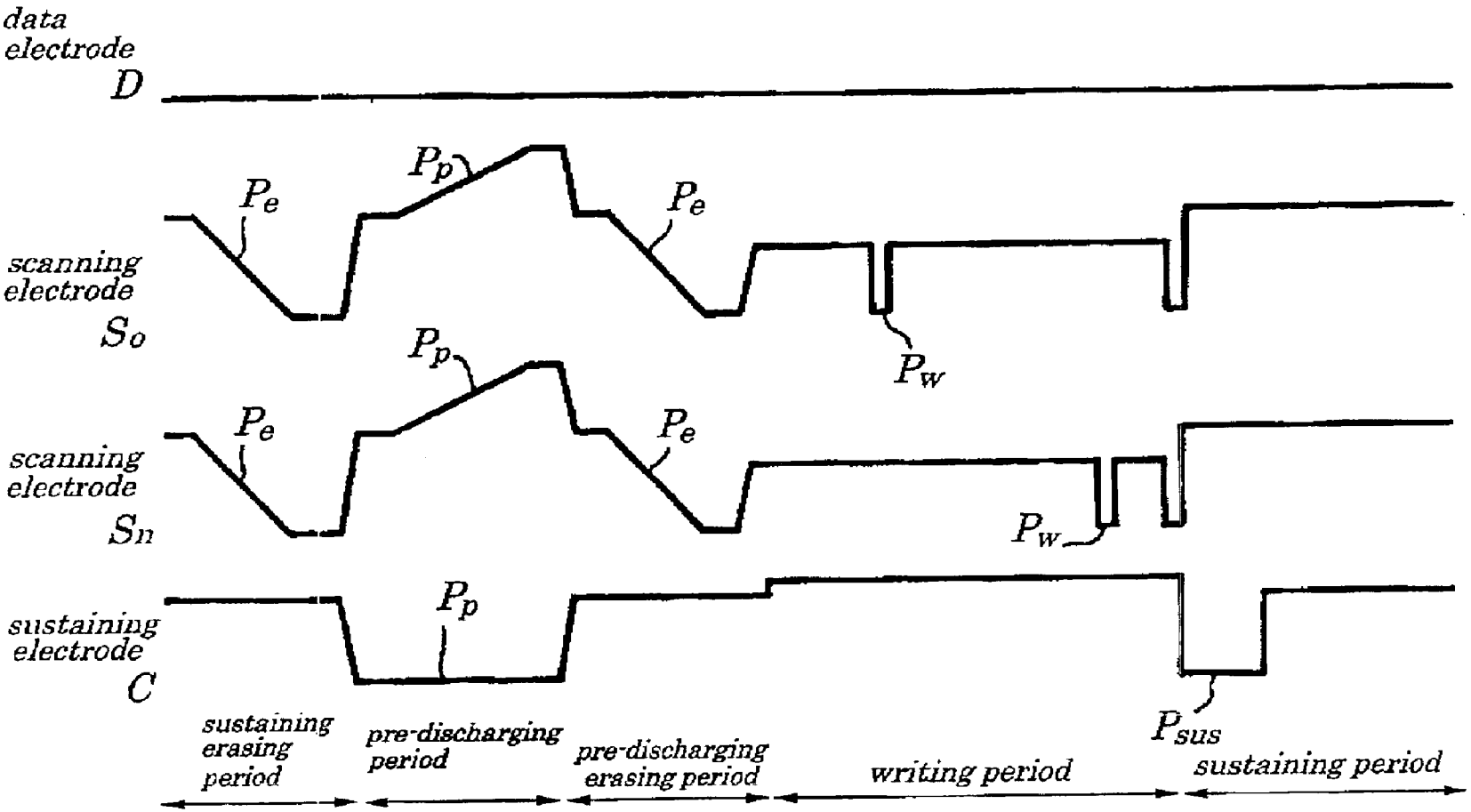
FIG. 2 is a timing chart showing configurations of a sub-field during a supply power stability waiting period according to the first embodiment of the present invention.

In the first embodiment, a driving method for one frame is changed between a period (supply power stability waiting period being here called a "first period") required until supply power becomes stable and a display period. FIG. 2 is a timing chart showing configurations of a sub-field set during a supply power stability waiting period in the first embodiment.

Figure 5:
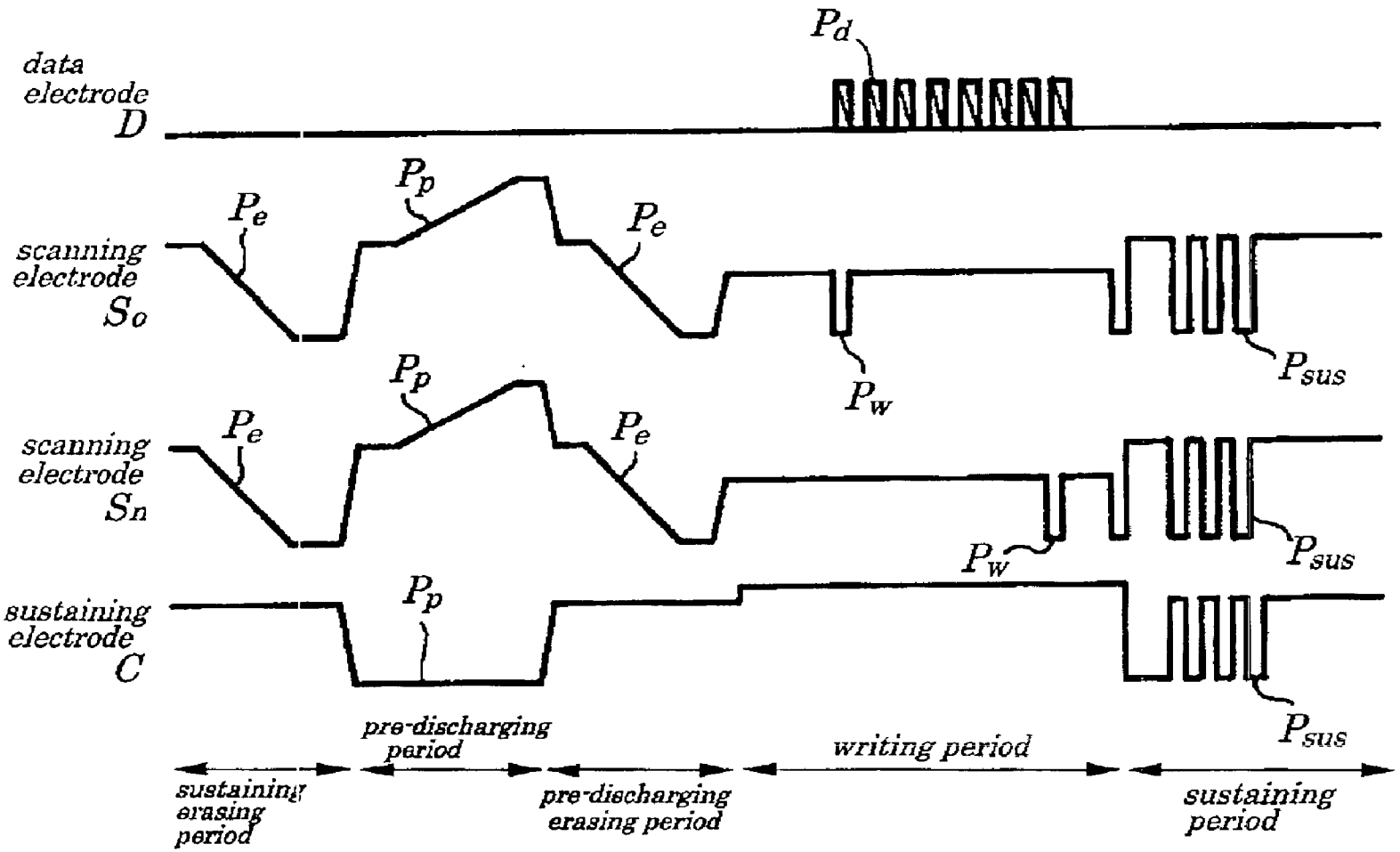
FIG. 5 is a timing chart showing a conventional method for driving the AC plasma display panel.
Figure 6:
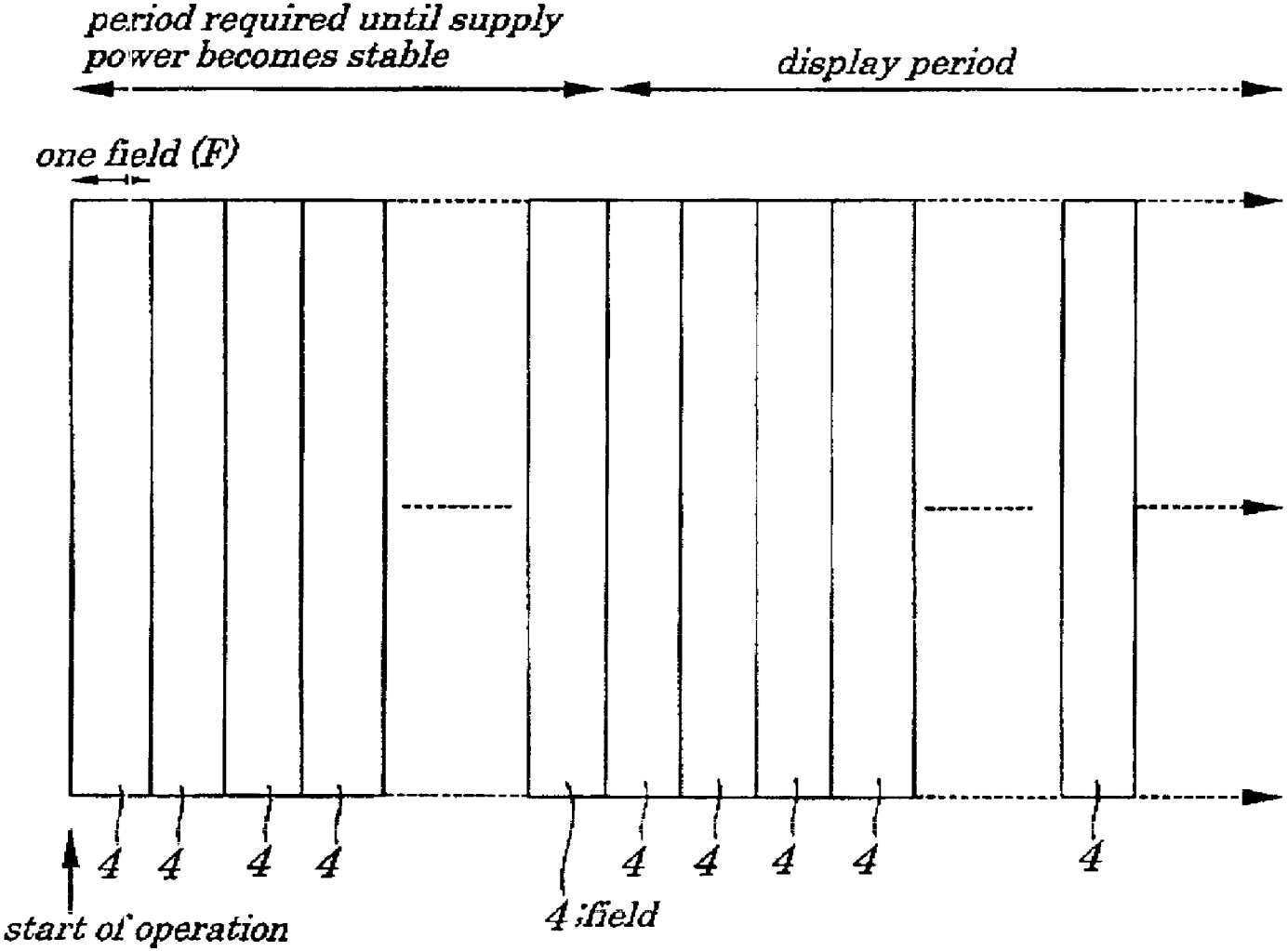
FIG. 6 is a timing chart showing a relation between elapsed time and display since a start of operations of the AC plasma display panel according to the conventional method.
Figure 7:
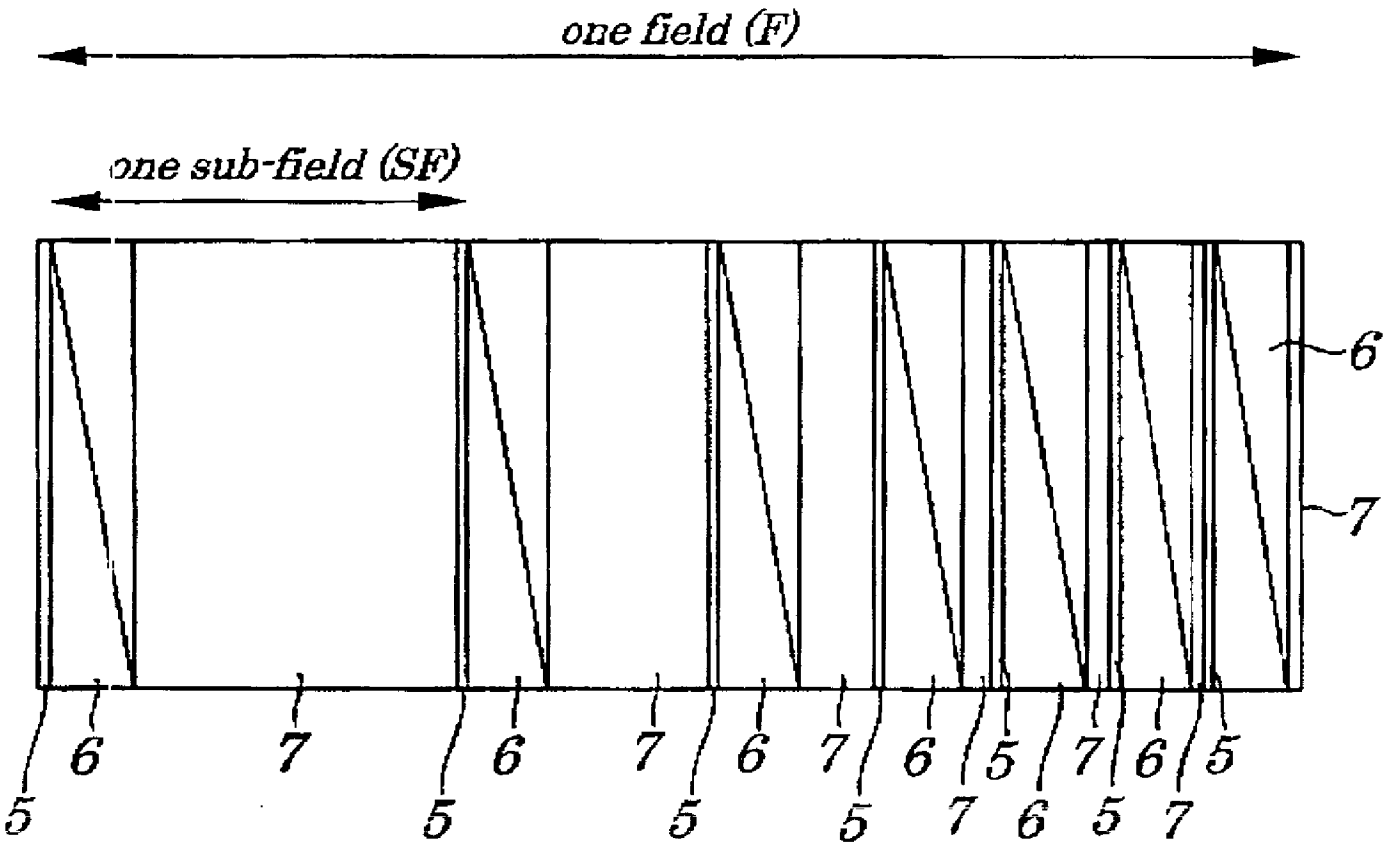
FIG. 7 is a timing chart explaining configurations in one field according to the conventional method.

The time required until supply power becomes stable is, for example, about 0.5 seconds to 1 second from power-ON (start of operations). In a field 1 within this period, a signal having a waveform shown in FIG. 2 is applied to each electrode. More particularly, during the supply power stability waiting period, one field 1 is divided into a plurality of sub-fields and, during a sustaining period of each sub-field, a number of repeated pulses are reduced compared with the case during the sustaining period shown in FIG. 5 (Prior Art) and, for example, no sustaining pulse is fed to a scanning electrode. Then, after a lapse of this period, one field 2 is divided into a plurality of sub-fields and, for example, a signal corresponding to image data as shown in FIG. 5 (Prior Art) is applied to each electrode and this period is defined as a display period (being called a second period) and by changing a number of times of discharging occurring during the sustaining period in each of the sub-fields and by combining these sub-fields, gray-scale display is achieved.

That is, the total number of sustaining pulses contained in each of the fields 1 in the supply power stability waiting period are set to be smaller than a total number of sustaining pulses contained in each of the fields 2 in a display period and a total number of sustaining light emissions contained in each of the fields 1 during the supply power stability waiting period are set to be smaller than a total number of sustaining light emissions contained in each of the fields 2 in the display period. For example, if a waveform shown in FIG. 2 is employed, since a potential of a data electrode within a writing period is at a low level, sustaining light emission does not occur in the sub-field.

According to the first embodiment, the number of repeated pulses in the sub-field set during the supply power stability waiting period are set to be smaller than that of repeated pulses in the sub-field set during the display period, even if erroneous discharge occurs due to an influence by residual charges at a time of operations of the AC plasma display panel, the sustaining light emitting caused by erroneous discharge becomes inconspicuous.

Moreover, there is no limitation to a length of a sub-field making up each field set during the supply power stability waiting period. For example, a length of the sub-field can be unified so as to be a constant length and the length of the sub-field can be equal to a length of the sub-field positioned in same order out of the sub-fields making up each field set during the display period.

Second Embodiment

Figure 3:
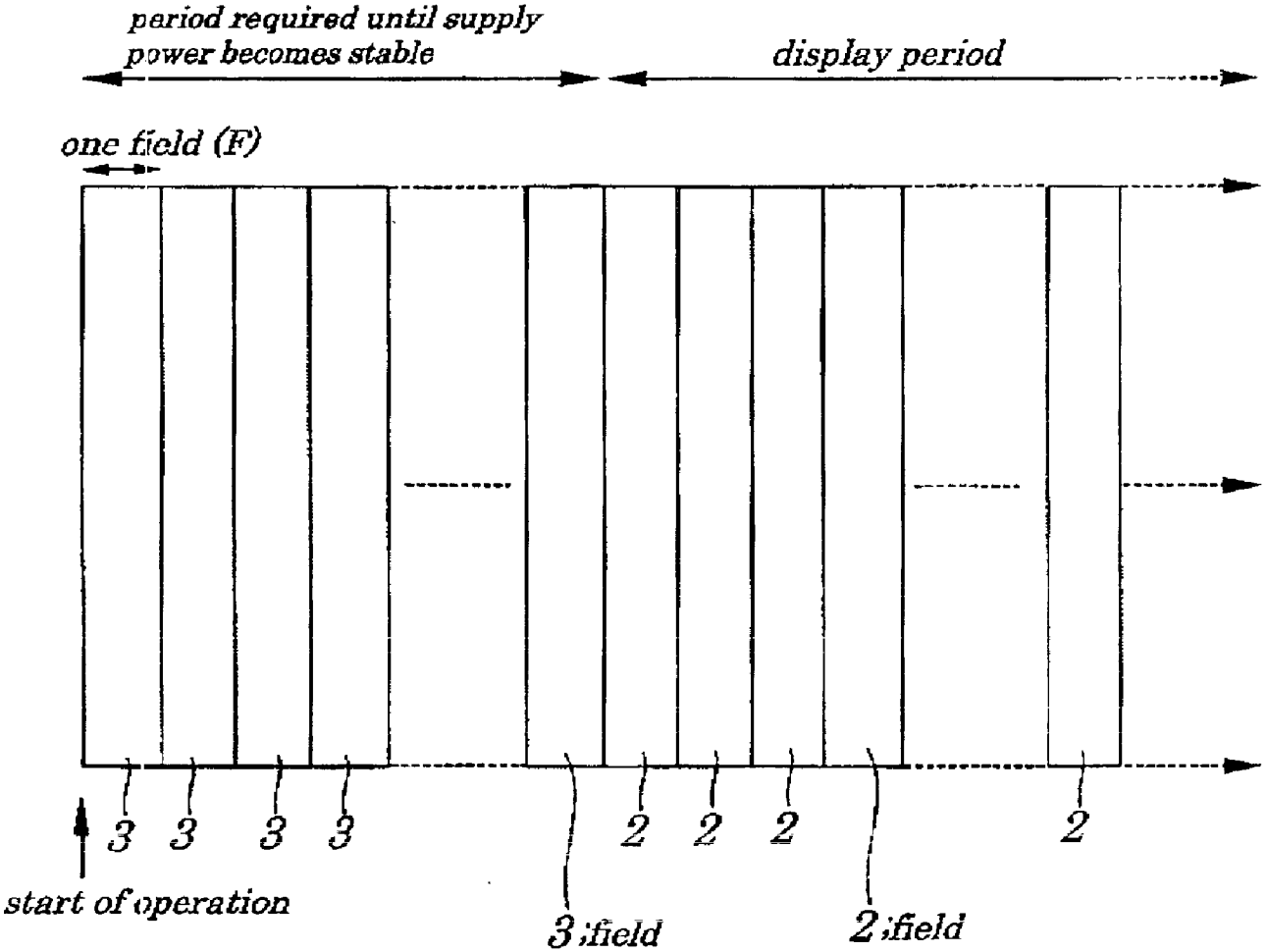
FIG. 3 is a timing chart showing a relation between time elapsed since a start of operations and display according to a method of driving an AC plasma display panel of a second embodiment of the present invention.
Figure 4:
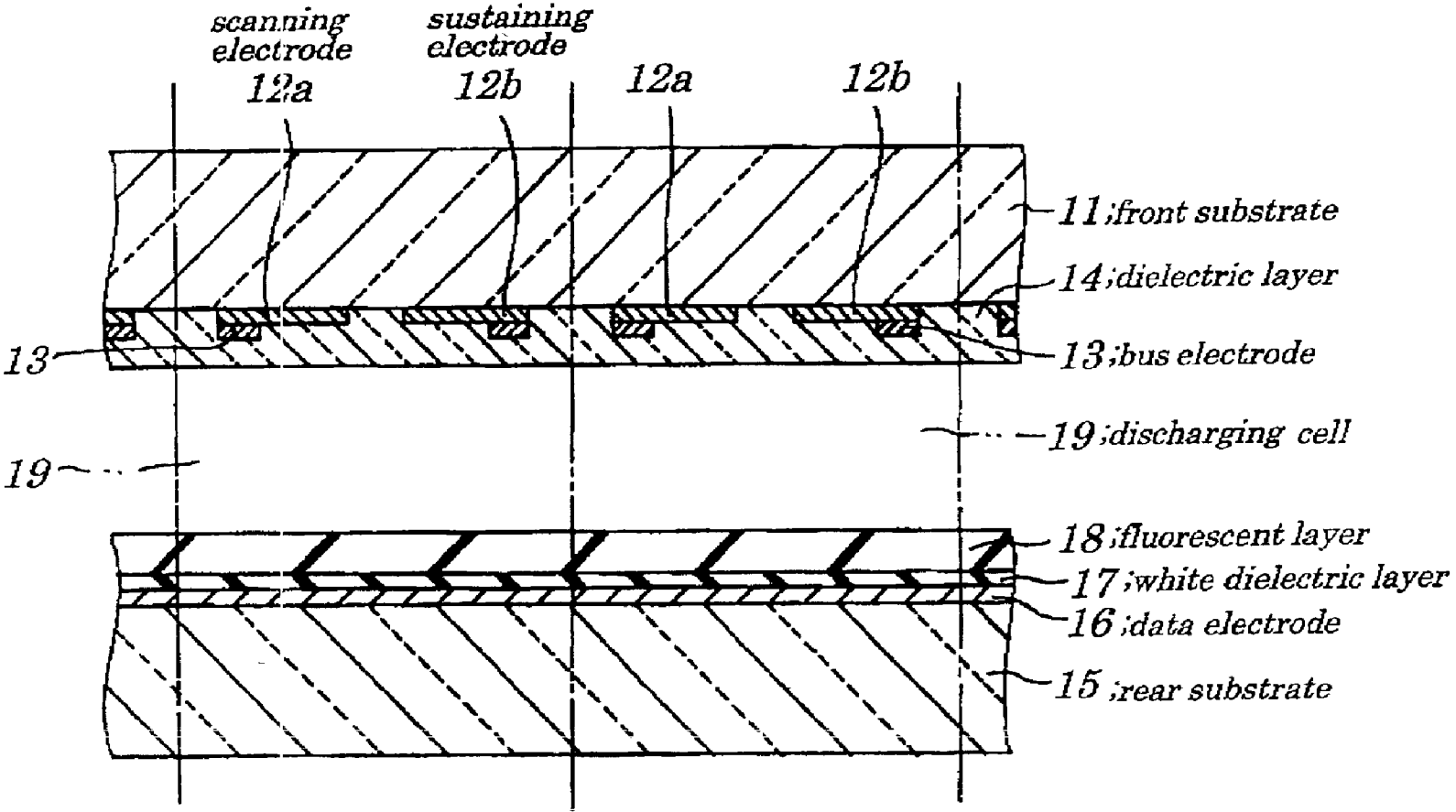
FIG. 4 is a cross-sectional view showing a conventional AC plasma display panel.

FIG. 3 is a timing chart showing a relation between elapsed-time and display since a start of operations of an AC plasma display device according to a method of driving an AC plasma display panel of a second embodiment. In the second embodiment, a driving method for one frame is changed between a supply power stability waiting period and a display period. In the second embodiment, a field 3 is divided into a plurality of sub-fields (SF) being shorter than a field 2 during a display period. As in the case of the first embodiment, during a sustaining period in each sub-field set during the supply power stability waiting period, signals as shown in FIG. 2 are fed to each electrode. Then, after a lapse of this period, one field 2 is divided into a plurality of sub-fields (SF) and, for example, each of signals corresponding to image data as shown in FIG. 5 (Prior Art) is applied to each electrode and this period is used as a display period and by changing a number of times of discharging occurring during the sustaining period in each of the sub-fields and by combining these sub-fields, gray-scale display is achieved.

Thus, according to the second embodiment, since configurations of a sub-field within a supply power stability waiting period are made the same as those employed in the first embodiment and a number of sub-fields making up a field 3 is set to be smaller than that of sub-fields making up a field 2, even if erroneous discharge occurs due to an influence by residual charges at a time of operations of the AC plasma display panel, sustaining light emission occurred due to erroneous discharge becomes more inconspicuous.

In the second embodiment, there is no limitation to a length of the sub-field making up each of the fields 2, 3 set during the supply power stability waiting period. For example, the length can be unified so as to be a constant length.

It is apparent that the present invention is not limited to the above embodiments but may be changed and modified without departing from the scope and spirit of the invention.

What is claimed is:

1. A method for driving an alternating current type plasma display panel to have said alternating current plasma display panel perform gray-scale display by dividing one field for displaying one screen into n-pieces ("n" is a natural number) of sub-fields and by setting a number of times of light emission in said sub-fields at values of two kinds or more, said method comprising:

a step of setting a first period during which predetermined time elapses after a start of operations of said alternating current plasma display panel and a second period during which display corresponding to an image signal is performed on said alternating current plasma display panel after a lapse of said first period; and a step of making a total number of sustaining light emissions contained in each field during said first period be smaller than a total number of sustaining light emissions contained in each field during said second period.

2. The method for driving an alternating current plasma display panel according to claim 1, wherein a sustaining erasing period, a pre-discharging period, a pre-discharging erasing period, a writing period, and a sustaining period are set for each sub-field.

3. The method for driving an alternating current plasma display panel according to claim 1, wherein the number of said sub-fields contained in each field set during said first period is made smaller than the number of said sub-fields contained in said each field set during said second period.

4. The method for driving an alternating current plasma display panel according to claim 1, wherein lengths of said sub-fields contained in said each field set during said first period are equal to each other.

5. The method for driving an alternating current plasma display panel according to claim 1, wherein a length of the sub-field contained in said each field set during said first period is equal to a length of the sub-field positioned in same order which is contained in said each field set during said second period.

6. The method for driving an alternating current plasma display panel according to claim 1, wherein, in said each field set during said first period, a potential of a data electrode is made less than a value produced by opposed discharge occurring between said data electrode and a scanning electrode during a writing period during which said scanning electrode is scanned.

7. The method for driving an alternating current plasma display panel according to claim 1, wherein a length of said first period is 0.5 seconds to 1 second.

8. A method for driving an alternating current type plasma display panel which comprises a first substrate and a second substrate being opposed to each other, a plurality of pairs of a scanning electrode and a sustaining electrode formed respectively on said first substrate, such that surface discharge is performed between each other, and a plurality of data electrodes formed on said second substrate, in such a manner to intersect said scanning electrode and said sustaining electrode, said method to have said alternating current plasma display panel perform gray-scale display by dividing one field for displaying one screen into n-pieces ("n" is a natural number) of sub-fields and by setting a number of times of light emission in said sub-fields at values of two kinds or more, said method comprising:

a step of setting a first period during which predetermined time elapses after a start of operations of said alternating current plasma display panel and a second period during which display corresponding to an image signal is performed on said alternating current plasma display panel after a lapse of said first period; and a step of making a total number of sustaining light emissions contained in each field during said first period be smaller than a total number of sustaining light emissions contained in each field during said second period.

9. The method for driving an alternating current plasma display panel according to claim 8, wherein a sustaining erasing period, a pre-discharging period, a pre-discharging erasing period, a writing period, and a sustaining period are set for each sub-field.

10. The method for driving an alternating current plasma display panel according to claim 8, wherein the number of said sub-fields contained in each field set during said first period is made smaller than the number of said sub-fields contained in said each field set during said second period.

11. The method for driving an alternating current plasma display panel according to claim 8, wherein lengths of said sub-fields contained in said each field set during said first period are equal to each other.

12. The method for driving an alternating current plasma display panel according to claim 8, wherein a length of the sub-field contained in said each field set during said first period is equal to a length of the sub-field positioned in same order which is contained in said each field set during said second period.

13. The method for driving an alternating current plasma display panel according to claim 8, wherein, in said each field set during said first period, a potential of a data electrode is made less than a value produced by opposed discharge occurring between said data electrode and a scanning electrode during a writing period during which said scanning electrode is scanned.

14. The method for driving an alternating current plasma display panel according to claim 8, wherein a length of said first period is 0.5 seconds to 1 second.

* * * * *